United States Patent [19]

Le Roux

[11] 4,225,838

[45] Sep. 30, 1980

[54] ELECTRO-MAGNETIC RELAY WITH FIRST AND SECOND SPRING BIASING MEANS

[75] Inventor: Edouard Le Roux, Barentin, France

[73] Assignee: Societe d'Appareillage Electrique Saparel, Saint-Marcellin, France

[21] Appl. No.: 927,222

[22] Filed: Jul. 24, 1978

[30] Foreign Application Priority Data

Jul. 29, 1977 [FR] France ..... 77 23429

[51] Int. Cl.[2] ..... H01F 7/04; H01H 20/34

[52] U.S. Cl. ..... 335/274; 335/194

[58] Field of Search ..... 335/193, 194, 200, 274, 335/277, 192, 170, 174, 38, 78, 79, 179, 180, 229, 230, 234, 236, 253, 254, 279, 280

[56] References Cited

U.S. PATENT DOCUMENTS

| | | | |
|---|---|---|---|
| 2,284,621 | 6/1942 | Kuhn et al. | 335/274 |
| 3,450,955 | 6/1969 | Johnson | 335/38 |

*Primary Examiner*—Harold Broome

*Attorney, Agent, or Firm*—Sughrue, Rothwell, Mion, Zinn and Macpeak

[57] ABSTRACT

A high sensitivity electromagnetic relay has a moving armature held against two pole pieces of a magnetic circuit by means of a permanent magnet. The armature is subject to the action of two return springs which tend to draw the armature off the pole pieces. A first, non-adjustable spring provides the main antagonistic torque while an adjustable spring which is a separate component part from the main spring is used for fine adjustment of the force acting against the permanent magnet. The amount of current flowing through a coil which is required to trip the relay can then be adjusted finely.

9 Claims, 2 Drawing Figures

ELECTRO-MAGNETIC RELAY WITH FIRST AND SECOND SPRING BIASING MEANS

FIELD OF THE INVENTION

The present invention relates to improvements in high sensitivity electro-magnetic relays according to the parent patent.

BACKGROUND OF THE INVENTION

French Pat. No. 2,331,877) describes an electro-magnetic relay having a moving armature which is mounted on an armature carrier which is subjected to a return spring whose tension is adjustable by means of a screw.

The aim of the invention is to improve the system for adjusting the tension of the return spring of the moving armature and thereby to improve the operation of the relay.

SUMMARY OF THE INVENTION

The present invention provides a high sensitivity electromagnetic relay comprising a moving armature held against two pole pieces of a magnetic circuit by means of a permanent magnet wherein the armature is subjected to the action of two return springs tending to draw the armature away from the pole pieces against the attraction of the permanent magnet, the springs comprising a first, non-adjustable spring and a second, adjustable spring, the springs being independent component parts arranged to act in concert.

The first spring is preferably so adjusted as to supply an opposing couple which is slightly below that required to adjust the relay to its least armature holding force, thereby guaranteeing a minimum relay torque.

The second spring is preferably a spiral spring placed between two branches of a magnetic circuit on the pivot axes of the armature and supplying the adjustment tension which corresponds to the desired sensitivity.

The spiral spring is preferably held fast to the rotation shaft of the armature and is associated with a ratchet wheel system comprising a tooth-wheel fast to the same shaft and a blade for stopping one tooth of the tooth-wheel, which blade may be deformed so as to release the tooth-wheel.

An embodiment of a relay in accordance with the invention is described by way of example with reference to the accompanying drawings.

DESCRIPTION OF THE PREFERRED EMBODIMENT

Figure 1:
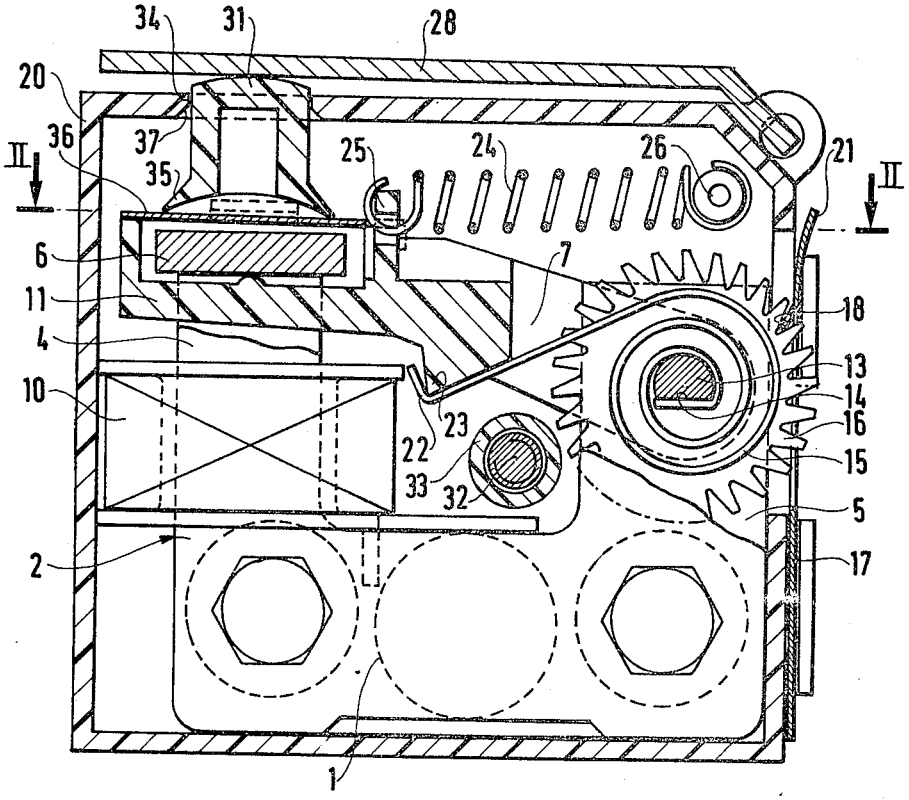
FIG. 1 is an elevation section, partially broken away, of the relay in its casing.
Figure 2:
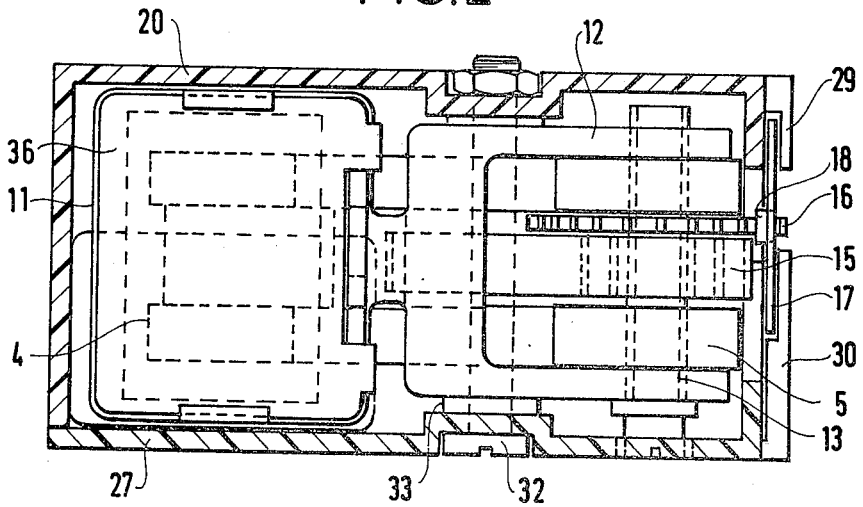
FIG. 2 is a plan view of the relay of FIG. 1.

In the embodiment shown, the relay comprises a permanent magnet 1 held between two U-shaped magnetic side pieces 2, having two arms 4 which form the poles that cooperate with the magnetic armature 6 and having two other arms 5 which form a pivot support for the armature carrier 7.

A release winding 10 is mounted on one of the pole branches 4 and its flux when it is fed with current, opposes that created by the permanent magnet 1 in the moving armature 6. The armature 6 is mounted in a cage 11 formed at the end of the armature carrier 7, the other end of which includes two separate arms 12 mountd free to rotate on an axle 13. The axle 13 is itself mounted for free rotation in two holes in the arms 5 of the magnetic circuit. The axle 13 includes a flat 14 enabling it to rotate the inner loop of a spiral spring 15, as well as a ratchet wheel constituted by a flat washer 16 having teeth on its outer circumference which engage a hook 18 in a slot of a stop-blade 17. The blade is fastened to a relay housing 20 and is sufficiently flexible to free the tooth-wheel by virtue of its upper end 21 moving away from the housing. The adjustment spring 15 and the toothed wheel 16 are placed between the two arms 5 of the magnetic circuit. The spring 15 is a spiral spring and its other end 22 is fastened to a projection 23 on the armature carrier. One or both of the ends of the axle 13 are shaped by means of a slot or a flat to enable the axle to be rotated and hence to enable the toothed wheel and the adjusting spring to be rotated.

A tension spring 24 is fixed between a high point 25 of the armature carrier 7 and a fixing point 26 of the housing. The spring 24 tends to draw the armature 6 away from the pole pieces 4. The relay is placed in the housing 20 which is provided with a cover 27.

An engagement and resetting lever 28 is mounted to rotate between lugs 29 and 30 of the housing and its cover, and presses against the engagement button 31.

The housing 20 and its cover 27 are arranged to be held together by a single screw 32 passing through the relay via an isolating tube 33 without communicating with the inside of the housing and hence those parts of the relay which are sensitive to dust. The engagement button 31 is freely mounted with clay in a hole 34 of the housing in such a manner as to reduce friction and to avoid jamming, while still retaining sufficient guidance.

The hollowed-out form of the base 35 of the engagement button, as it rests on the plate 36 of the armature carrier, tends to place the button perpendicularly to its contact face on the plate. The hole 34 in the housing has a chamfer 37 on its inner side thereby providing guidance over a very small length and enabling the button to lean over appreciably without taking up a position which would be likely to cause jamming. This arrangement in conjunction with the material used: (a low coefficient of friction thermoplastic material of the acetal copolymer type of resin) reduces energy losses due to friction during release.

The shape of the housing and the possibility of adjusting the spiral spring 15 driving axle 13 from either of its ends makes mounting on the housing or the cover side of the relay equally possible.

Operation of the device described is as follows:

The tension spring 24 provides an opposing couple which is slightly below that required to set the relay to its least total holding force, thereby guarateeing the minimum motor couple for each manufactured relay.

When the relay is being adjusted by the adjusting axle 13, rotation of this axial causes the toothed wheel 16 to rotate and the spiral spring is wound in a direction to increase the opposing couple and adjust the release current. The fixing of the teeth of the toothed wheel in the blade 17 fixes the angle of rotation and the tension of the spring. The adjustment can be brought back by disengageing the hook 18 of the blade 17 from the teeth of the wheel 16. The release of the armature 6 of the magnetic circuit cause the armature carrier 7 to rotate and the button 13 leaves the housing. This movement of the button represents the work supplied by the relay.

Resetting the relay is performed by the action of the engagement lever 28 on the release button 31 to stick the armature back on the magnetic circuit.

I claim:

1. A high sensitivity electro-magnetic relay comprising:

a casing, magnetic circuit means including two laterally spaced, U-shaped side pieces having arms at respective ends, one pair of said arms forming two fixed pole pieces, an armature carrier pivotably supported to said other pair of arms, an armature carried by said carrier and spanning across the ends of said two pole pieces and forming part of a magnetic circuit, a permanent magnet sandwiched between said U-shaped magnetic side pieces for holding said armature against said two pole pieces, and spring biasing means for biasing the armature away from said pole pieces and against the attraction of the permanent magnet, the improvement wherein said spring biasing means comprises a first, non-adjustable spring and a second, adjustable spring, and wherein said springs comprise independent component parts coupled to said armature for action in concert.

2. A relay according to claim 1, wherein said first spring is of a spring constant and is mounted with respect to said armature such that it provides an opposing couple which is slightly below that required for adjustably moving the relay to its position of least force for holding the armature against the pole pieces and to thus guarantee the minimum motor couple of the relay.

3. A high sensitivity electro-magnetic relay comprising:

magnetic circuit means including two laterally spaced, U-shaped side pieces having arms at respective ends, one pair of said arms forming two fixed pole pieces, an armature carrier pivotably supported to said other pair of arms, an armature carried by said carrier and spanning across the ends of said two pole pieces and forming part of a magnetic circuit, a permanent magnet sandwiched between said U-shaped magnetic side pieces for holding said armature against said two pole pieces, and spring biasing means including a first and second spring for biasing the armature away from said pole pieces and against the attraction of the permanent magnet, the improvement wherein said magnetic circuit means comprises two branches, said armature is pivoted at said two branches and one of said first and second springs comprises an adjustable spiral spring positioned between the two branches on the basis of rotation of the armature to supply an adjustable tension to said armature corresponding to the desired sensntivity of relay operation.

4. A relay according to claim 3, wherein the second spring is fixed to a shaft on which the armature rotates and said relay further includes a ratchet wheel system comprising a toothed wheel fixed to the same shaft and a blade operatively positioned with respect to the toothed wheel for blocking a tooth of the toothed wheel, said blade being deformable with the relase of the toothed wheel.

5. A relay according to claim 1, wherein the moving armature is mounted on an armature carrier mounted to rotate freely on the shaft axis.

6. A relay according to claim 5, wherein the armature carrier includes two legs between which the adjusting spring and the ratchet wheel system are placed.

7. A relay according to claim 1, further including an engagement button on said armature and an engagement and resetting lever pivoted on the casing.

8. A relay according to claim 1 wherein said engagement button has a hollow face mounted in a hole of the casing, said casing hole having a chamfer such as to reduce friction during release.

9. A relay according to claim 1, wherein said casing includes an insulating tunnel and said casing is fixed by a single screw passing through said insulating tunnel without communicating with the inside of said casing.

* * * * *